United States Patent [19]

Tomat et al.

[11] Patent Number: 4,932,231

[45] Date of Patent: Jun. 12, 1990

[54] TWO-FUNCTION COIL-FORMING ASSEMBLY

[75] Inventors: Ferruccio Tomat, Udine; Guiseppe Bordignon, Bicinicco, both of Italy

[73] Assignee: Danieli & C. Officine Meccaniche SpA, Buttrio, Italy

[21] Appl. No.: 308,477

[22] Filed: Feb. 10, 1989

[30] Foreign Application Priority Data

Feb. 29, 1988 [IT] Italy ..... 83330 A/88

[51] Int. Cl.[5] ..... B21C 47/04; B21C 47/14; B21B 41/00

[52] U.S. Cl. ..... 72/148; 242/83

[58] Field of Search ..... 72/66, 135, 146, 148, 72/200, 201, 202; 242/79, 81, 82, 83

[56] References Cited

U.S. PATENT DOCUMENTS

| | | | |
|---|---|---|---|
| 2,073,928 | 3/1937 | Gassen | 242/83 |
| 3,020,000 | 2/1962 | Morgan | 242/81 |
| 4,513,922 | 4/1985 | Dufour | 242/83 X |
| 4,807,457 | 2/1989 | Polino et al. | 72/148 X |

FOREIGN PATENT DOCUMENTS

| | | |
|---|---|---|
| 0271129 | 6/1988 | European Pat. Off. . |
| 1000769 | 6/1952 | Fed. Rep. of Germany . |
| 60520B | 12/1986 | Italy . |
| 712799 | 7/1954 | United Kingdom . |
| 976787 | 12/1964 | United Kingdom . |

*Primary Examiner*—E. Michael Combs
*Attorney, Agent, or Firm*—Wegner & Bretschneider

[57] ABSTRACT

Two-function coil-forming assembly which cooperates with channels (14–15) feeding rolled stock and with at least one drum (20) forming coiled bundles and having an axis at least momentarily vertical and comprises at least two feeder units (25) having different individual functions (12–13), the assembly including a rotatable column (11) having a substantially vertical axis and able to take up at least two circumferential positions to support and position the feeder units (25), at least one of the feeder units (25) being momentarily in direct association with the drum (20) forming coiled bundles.

7 Claims, 2 Drawing Sheets

TWO-FUNCTION COIL-FORMING ASSEMBLY

Figure 1:
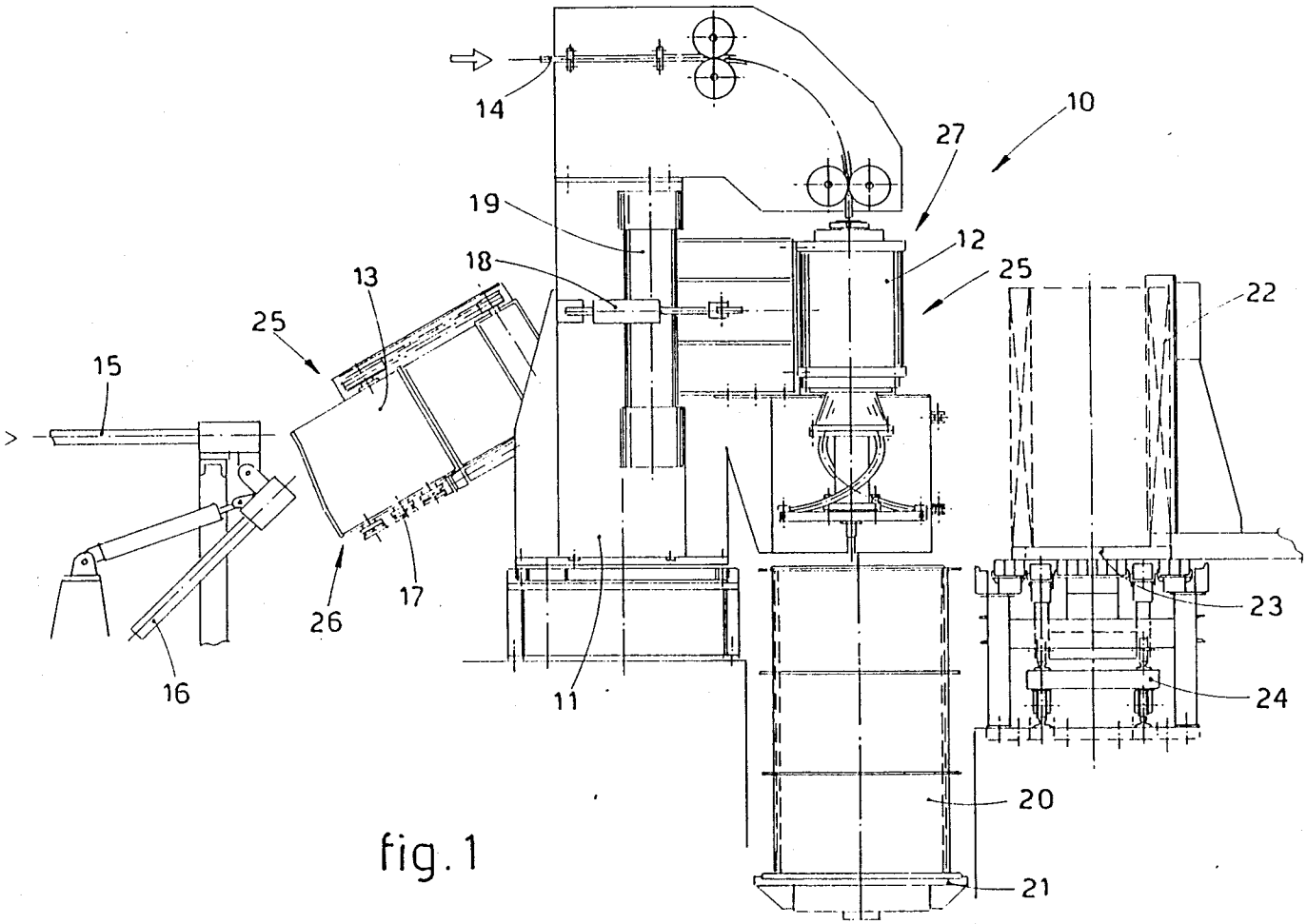

This invention concerns a two-function coil-forming assembly. To be more exact, the invention concerns a coil-forming assembly suitable to cooperate with a drum forming coiled bundles of wire having a diameter ranging from 10 to 20 mm. or greater.

Such wire is produced by hot-rolling and comes from a rolling line positioned upstream.

A proposal in the name of the present applicant exists according to which two pairs of headstocks, of which each pair comprises a pre-bending Garret headstock and an Edenborn headstock, are provided in a cooling line at the sides of a Garret-type turret forming coiled bundles.

In the above proposal in application No. IT 60520 B/86 the pairs of headstocks are fitted to a movable carriage able to put to work the most suitable unit.

These units feeding the turret that forms coiled bundles are fed by channels which feed rolled stock and comprise suitable switching means.

The embodiment according to the above IT 60520 B/86 entails both general and particular problems as regards timing. It also makes it necessary that the feeder units should be placed at a given distance from the bundle-forming turret.

Moreover, this proposal makes necessary for the removal of the coiled bundles thus produced a plurality of auxiliary movements which are, in fact, quite complex.

According to this proposal it is possible to process a wide range of rod, such range covering a very small section of about 4–6 mm. up to sections of 18–20 mm. or more.

The present applicant has now shown that it is possible to overcome the shortcomings of the above proposal and to arrange for the coil-forming unit to be in direct, immediate cooperation with the turret or drum forming the coiled bundles and at the same time to work with feeder units having different individual functions.

Such feeder units may consists of an Edenborn-type headstock or a Garrett-type pre-bending assembly.

The present applicant has therefore designed, tested and embodied this invention, which tends to overcome the drawbacks of the know proposal and to provide a plurality of advantages.

A first advantage is the fact that, when the feeder units are in their working position, they can cooperate with the Garrett-type drum at a position immediately upstream thereof without any substantial break in continuity, thus enabling the coils to be positioned at once in a required manner.

Furthermore, the invention enables the coiled bundle to be readily discharged by means of a simple lateral movement of the individual feeder unit working at that moment.

Moreover, the invention enables the coiled bundles formed in a substantially known manner to be swiftly and easily handled.

The advantages and purposes of this invention are achieved by a two-function coil-forming assembly as specifically disclosed in the main claim and in one or another of the connected claims describing particular forms of embodiment of the invention.

According to the invention a rotatable column having a substantially vertical axis and bearing at least two different individual feeder units is included in close cooperation with the Garrett drum, such feeder units consisting of an Edenborn headstock and a pre-bending Garrett assembly.

According to a first embodiment the two different individual feeder units are positioned substantially at 180° opposite to each other on the rotatable column According to a variant two plus two different individual feeder units are positioned on the column.

According to this variant these different individual feeder units consist of two Edenborn coil-forming headstocks and two pre-bending Garrett assemblies.

This embodiment of the variant permits that, while one individual feeder unit is working, its twin individual feeder unit can undergo maintenance without any need to halt rolling therefor except possibly for a very short time.

According to another variant each different individual feeder unit is secured to the rotatable column in such a way that it can be oriented and can therefore be rotated by a required angle in relation to the working position.

This variant enables the Garrett drum to be freed momentarily from any encumbrance above it at the end of formation of a coiled bundle, thus allowing a movable plate to rise and lift the coiled bundle so that suitable engagement forks can taken the bundle and discharge it onto a removal conveyor.

According to a further variant two drums forming bundles can cooperate with the position of formation of the coiled bundles so that, when a drum holds a formed bundle, it is displaced for removal thereof while the other drums to form coiled bundles takes the place of the first drum.

Figure 2:
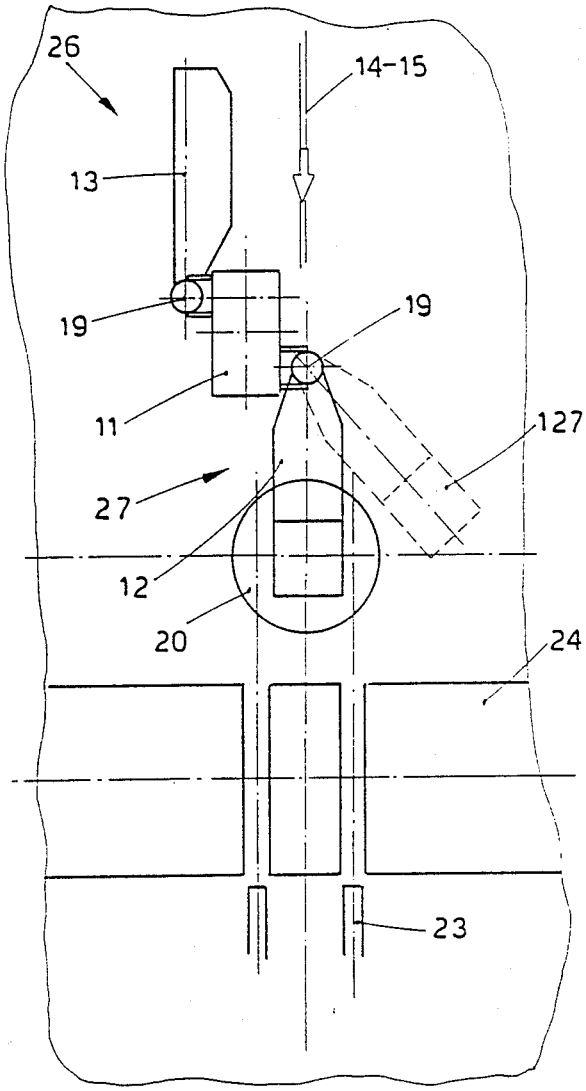

With the help of the attached figures, which are given as a non-restrictive example, let us now see a preferred embodiment of the invention. The figures show the following:

FIG.1 gives a side view of an embodiment according to the invention;

FIG.2 shows a diagrammatic plan view of the embodiment of FIG. 1.

In the figures a feeder assembly or two-function coil-forming assembly 10 comprises a rotatable column 11 having a substantially vertical axis.

Rotary actuation of the rotatable column 11 and its positioning in a desired specific position are performed with a known system suitable for the purpose.

As this is not a substantial part of the invention, the actuation system and positioning means are not shown.

The rotatable column 11 cooperates with at least one Garrett drum 20, which in the case comprises a known movable plate 21 able to lift a coiled bundle 22 when formed and bring it up to the level of a removal conveyor 24.

In this instance, when the coiled bundle 22 is at the required level, it is first engaged and then traversed by engagement forks 23.

The lifting of the bundle by the movable plate 21, its displacement and removal by the engagement forks 23 and its discharge by removal conveyor 24 are, for instance, part of the state of the art and are cited here not for restrictive reasons but only to complete the description.

The rotatable column 11 cooperates with channels 14 and 15 respectively feeding rolled stock belonging to the ranges of rolled rods having sections in the low range and high range of the field of sections envisaged, which covers sections of about 10 mm. in diameter up to 20 mm. or more in diameter.

Each of the feed channels 14–15 cooperates respectively with a different individual feeder unit 25 when the feeder unit is in its working position.

If necessary, the feed channel 15 cooperating with a prebending assembly 13 in avoiding any danger of contact when the pre-bending assembly 13 is in its inactive position or when it is moving to that position, may comprise a retractable portion or element 16 which frees the zone taken up when functioning is taking place in a known manner.

When the pre-bending assembly 13 is in a working position 27, the feed channel 15 feeds the rolled stock thereto, and the rolled stock is taken, pre-bent, fed onwards and delivered by rollers 17.

The different individual feeder units 25 are secured to the rotatable column 11.

In the smallest embodiment of the invention one of the individual different feeder units 25 consists of an Edenborn coil-forming headstock 12, while the other is a pre-bending Garrett assembly 13.

In the case shown the coil-forming headstock 12 and the pre-bending assembly 13 are fitted in an orientable manner to the rotatable column 11 by means of an inclined arm attachment 19.

The different individual feeder units 25, being an Edenborn coil-forming headstock 12 and a pre-bending assembly 13, can be oriented by a jack 18, for instance, on the axis of the inclined arm attachment 19. This jack 18 is anchored to the rotatable column 11 and to the feeder unit 25.

Thus, the coil-forming headstock 12 and the prebending assembly 13 can take up an inactive position 26 and a coiling and working position 27.

In the case in question, when the feeder units 25 are in their working position 27, they can take up a first working or coiling position 27 and a second position 127 form removal of coiled bundles. This second position 127 is such that it frees momentarily the upper part of the Garrett drum 20.

According to a variant the orientation of the feeder units 25 can also be achieved by acting on the rotatable column 11.

We claim:

1. A coil forming assembly cooperating with channels for directing rolled stock thereto, said assembly comprising at least two rolled stock feeder units; a single coiling drum for receiving said rolled stock from either of said feeder units; said feeder units being mounted in spaced relationship on a rotatable column having a substantially vertical axis, said rotatable column being mounted for rotation between at least two circumferentially spaced positions for selectively positioning either of said at least two feeder units in direct alignment with said drum for forming coiled bundles of said rolled stock thereon.

2. The assembly as claimed in claim 1, wherein at least one of said at least two feeder units is an Edenborn coil-forming headstock.

3. The assembly as claimed in claim 1, wherein at least one of said at least two feeder units is a Garrett-type prebending assembly.

4. The assembly as claimed in claim 1, wherein each of said at least two feeder units can alternatively be disposed in a working range of positions and an inactive range of positions.

5. The assembly as claim in claim 4, wherein each of said at least two feeder units while in said working range of positions can alternatively be moved between a working position in direct association with the drum forming coiled bundles and a position for freeing the drum forming coiled bundles.

6. The assembly as claimed in claim 5, wherein each of said at least two feeder units is displaced from said working position to said position for freeing the drum forming coiled bundles by rotating said rotatable column.

7. The assembly as claimed in claim 5, wherein each of said at least two feeder units is displaced from said working position to said position for freeing the drum forming coiled bundles by laterally moving said rotatable column.

* * * * *